US006331046B1

(12) United States Patent
Yakushiji et al.

(10) Patent No.: US 6,331,046 B1
(45) Date of Patent: Dec. 18, 2001

(54) ELECTROSTATIC INKJET HEAD HAVING AN INK DRAIN FOR DRAINING INK FROM A SLIT

(75) Inventors: Toru Yakushiji; Tadashi Mizoguchi; Junichi Suetsucu; Hitoshi Minemoto; Hitoshi Takemoto; Kazuo Shima; Yoshihiro Hagiwara, all of Niigata (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/146,469

(22) Filed: Sep. 3, 1998

(30) Foreign Application Priority Data

Sep. 4, 1997 (JP) ..... 9-239795

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 31; 399/271, 290, 292, 294, 295

(56) References Cited

U.S. PATENT DOCUMENTS

| | | | |
|---|---|---|---|
| 4,403,234 | | 9/1983 | Miura et al. . |
| 6,059,399 | * | 5/2000 | Suetsugu et al. ..... 347/55 |
| 6,097,407 | * | 8/2000 | Terasawa et al. ..... 347/31 |

FOREIGN PATENT DOCUMENTS

| | | |
|---|---|---|
| 0780740 | 6/1997 | (EP) . |
| 58-69062 | 4/1983 | (JP) . |
| 60-228162 | 11/1985 | (JP) . |
| 1-165452 | 6/1989 | (JP) . |
| 1165452 | 6/1989 | (JP) . |
| 6-270417 | 9/1994 | (JP) . |
| 9066611 | 3/1997 | (JP) . |
| 10-86380 | 4/1998 | (JP) . |

OTHER PUBLICATIONS

Japanese Office Action issued Jun. 28, 1999 in connection with a related application.
English–language translation of relevant portions of the Jun. 28, 1999 Japanese Office Action.
European Search Report (in English) issued Dec. 7, 1999 in a related application.

* cited by examiner

*Primary Examiner*—Raquel Yvette Gordon
(74) *Attorney, Agent, or Firm*—Ostrolenk, Faber, Gerb & Soffen, LLP

(57) ABSTRACT

An inkjet device ensuring reliable and stable ink ejection is disclosed. A plurality of ejection electrodes are arranged in a housing having an ink chamber containing ink including toner particles and a gate electrode plate is placed at a predetermined distance from the ejection electrodes. The gate electrode plate has a slit formed such that the ejection electrodes are directed to the slit and an ink drain coupled to the slit for draining ink from the slit.

16 Claims, 4 Drawing Sheets

ELECTROSTATIC INKJET HEAD HAVING AN INK DRAIN FOR DRAINING INK FROM A SLIT

BACKGROUND OF THE INVENTION

1. Field of the Invention

The present invention relates to an inkjet recording apparatus which is capable of ejecting particulate matter such as pigment matter and toner matter by making use of an electric field, and more particularly to an improved arrangement of the inkjet recording apparatus.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet head and a counter electrode which is disposed behind the recording medium to form an electric field. The electrostatic inkjet head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. An inkjet head like this is disclosed, for example, in Japan Laid-Open Patent Publication No. 60-228162.

As another conventional example, there has been disclosed an electrostatic inkjet head having a gate electrode provided in front of an ink electrode in Japan Laid-Open Patent Publication No. 1-165452. The gate electrode has an opening or slit through which ink droplets are jetted. Since the distance between the gate electrode and the ink electrode is relatively short, ink ejection occurs when applying a lower driving voltage to the ink electrode.

However, when the inkjet head starts moving, vibrations from head movement cause the ink in the ink chamber to flow from the nozzle of the inkjet head to outside, which eventually forms an ink bridge between the nozzle and the opening of the gate electrode. There are cases where the opening of the gate electrode is blocked with the ink bridge and ink ejection becomes impossible, resulting in deteriorated printing quality. Even in the case of no ink bridge, the jetted ink is left in meniscus form in the opening of the gate electrode, which may also causes impossible ink ejection.

SUMMARY OF THE INVENTION

An object of the present invention is to provide an inkjet head that can perform ink ejection with reliability and stability.

Another object of the present invention is to provide a novel arrangement of an inkjet head that can effectively remove remaining ink from an opening in front of an ejection electrode.

According to the present invention, an inkjet head is provided with a plurality of ejection electrodes arranged in an ink chamber containing ink including particulate matter. The inkjet head is further provided with a front end plate that is laced at a predetermined distance from the ejection electrodes. The front end plate has a slit formed such that the ejection electrodes are directed to the slit and an ink drain coupled to the slit for draining ink from the slit.

The ink drain may has at least one drain slit formed in the front end plate and a width of the drain slit may be smaller than that of the slit so that capillary action occurs.

Further, the ink drain may include at least one drain slit formed in the front end plate and an ink absorber provided to the front end plate at a position corresponding to the drain slit.

The front end plate may be a conductive plate to which a predetermined voltage is applied to generate a voltage difference causing ink ejection of an ejection electrode when the ejection electrode is driven.

Since the ink drain is coupled to the slit to drain ink from the slit, even though an ink bridge is formed between the ejection electrodes and the front end plate due to vibrations or the like, the ink is immediately removed from the slit through the ink drain. Therefore, reliable and stable ink ejection can be achieved.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Figure 1:
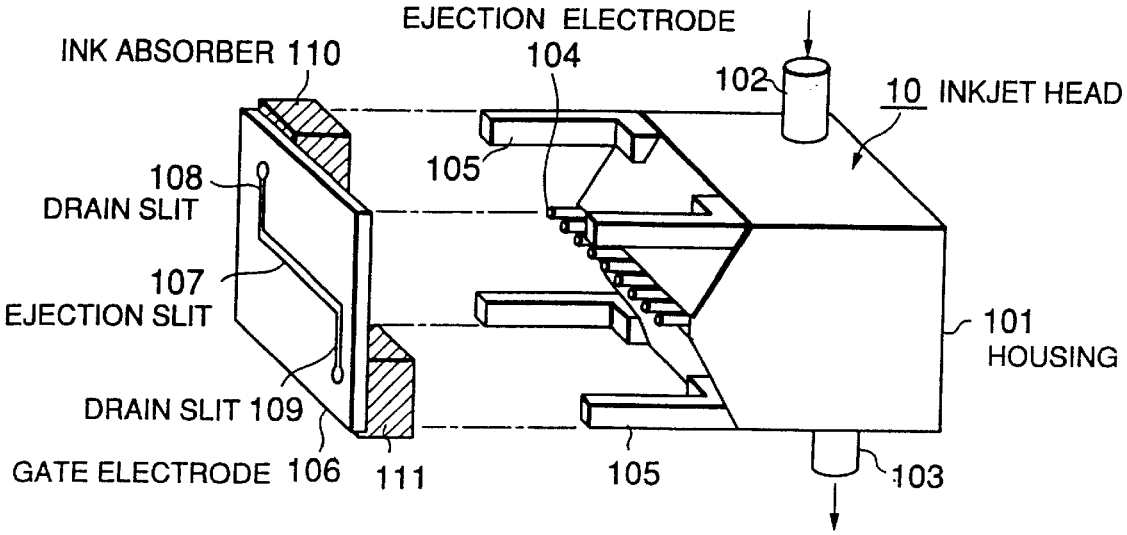
FIG. 1 is a part-exploded perspective view showing the schematic constitution of an inkjet recording apparatus according to an embodiment of the present invention.

Referring to FIG. 1, an inkjet head 10 is comprised of a housing 101 that is provided with an ink supply port 102 and an ink discharge port 103 on the top and bottom thereof. An array of ejection electrodes 104 is provided within the ink chamber of the housing 101 such that the front ends of the ejection electrodes 104 protrude through the nozzle formed in the front surface of the hosing 101. Each ejection electrode ejects the particulate matter from the protruding end thereof when a driving voltage is applied thereto.

The housing 101 is further provided with arms 105 each having a predetermined length extending in the ink-ejection direction and the arms 105 has a gate electrode 106 fixed thereto. The gate electrode 106 is shaped like a plate and has an ejection slit 107 and drain slits 108 and 109 cut through the plate thereof. The gate electrode 106 is placed at a predetermined distance from the front ends of the ejection electrodes 104 such that the particulate matter ejected from the ejection electrodes 104 passes through the ejection slit 107. The gate electrode 106 is a conductive plate made of metal. The gate electrode 106 further has a pair of ink absorbers 110 and 111 fixed on the back thereof corresponding respectively to the drain slits 108 and 109. In other words, the drain slits 108 and 109 forms an ink absorbing means with the ink absorbers 110 and 111. The details of the gate electrode 106 will be described hereinafter.

Figure 2:
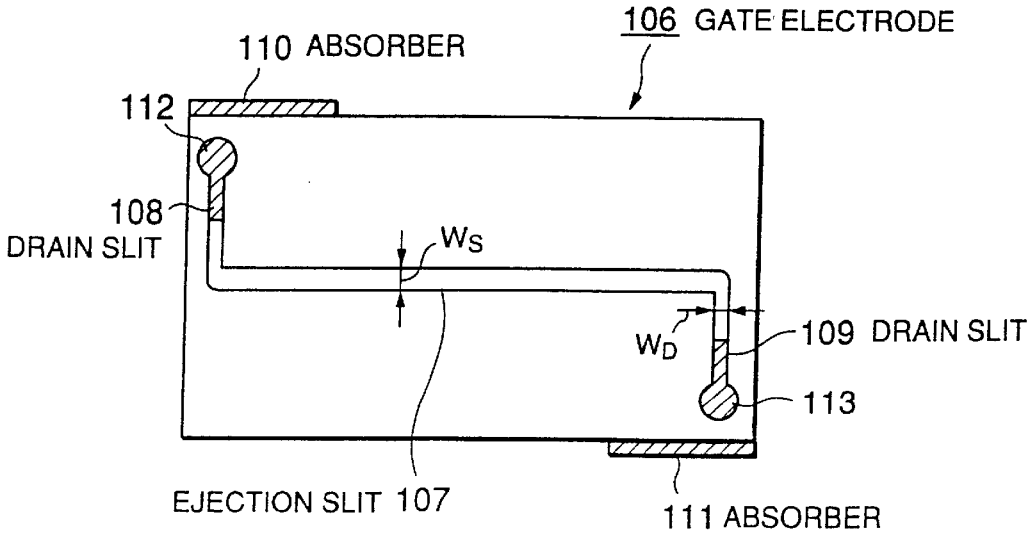
FIG. 2 is a plan view showing a gate electrode used in the inkjet recording apparatus as shown in FIG. 1.

Referring to FIG. 2, the gate electrode 106 has the ejection slit 107 extending in the direction of the array of the ejection electrodes 104 so that ink droplets including particulate matter ejected from the ejection electrodes 104 pass through the ejection slit 107. The gate electrode 106 has the drain slits 108 and 109 extending to end openings 112 and 113, respectively. The respective ink absorbers 110 and 111 are provided at the positions of the drain slits 108 and 109. The ejection slit 107 is coupled to the drain slits 108 and 109 at the ends thereof. In other words, a single bent slit is formed with the ejection slit 107 and the drain slits 108 and 109 which are coupled to each other.

The width $W_D$ of the drain slit 108 and 109 is much smaller than the width $W_S$ of the ejection slit 107. As described before, the width $W_S$ of the ejection slit 107 is designed to allow an ejected ink droplet to pass through the ejection slit 107. The drain slit 108 and 109 are designed to drain the remaining ink from the ejection slit 107. More specifically, the width $W_D$ of the drain slit 108 and 109 is determined so that the capillary action occurs. Therefore, even when an ink bridge is formed and some ink remain in the ejection slit 107, the remaining ink is drained from the ejection slit 107 and flows into the absorbers 110 and 111 through the drain slit 108 and 109 by capillary action.

The whole shape of the slits 107–109 is not limited to that as shown in FIG. 2 as long as the remaining ink is drained from the ejection slit 107. Three or more drain slits may be formed in the gate electrode and an absorber for each drain slit may be provided on the back of the gate electrode 106.

The ink absorbers 110 and 111 are made of material having the property of absorbing ink. Further, it is possible to provide the ink absorbers 110 and 111 with ink suction means to enhance ink draining.

Figure 3:
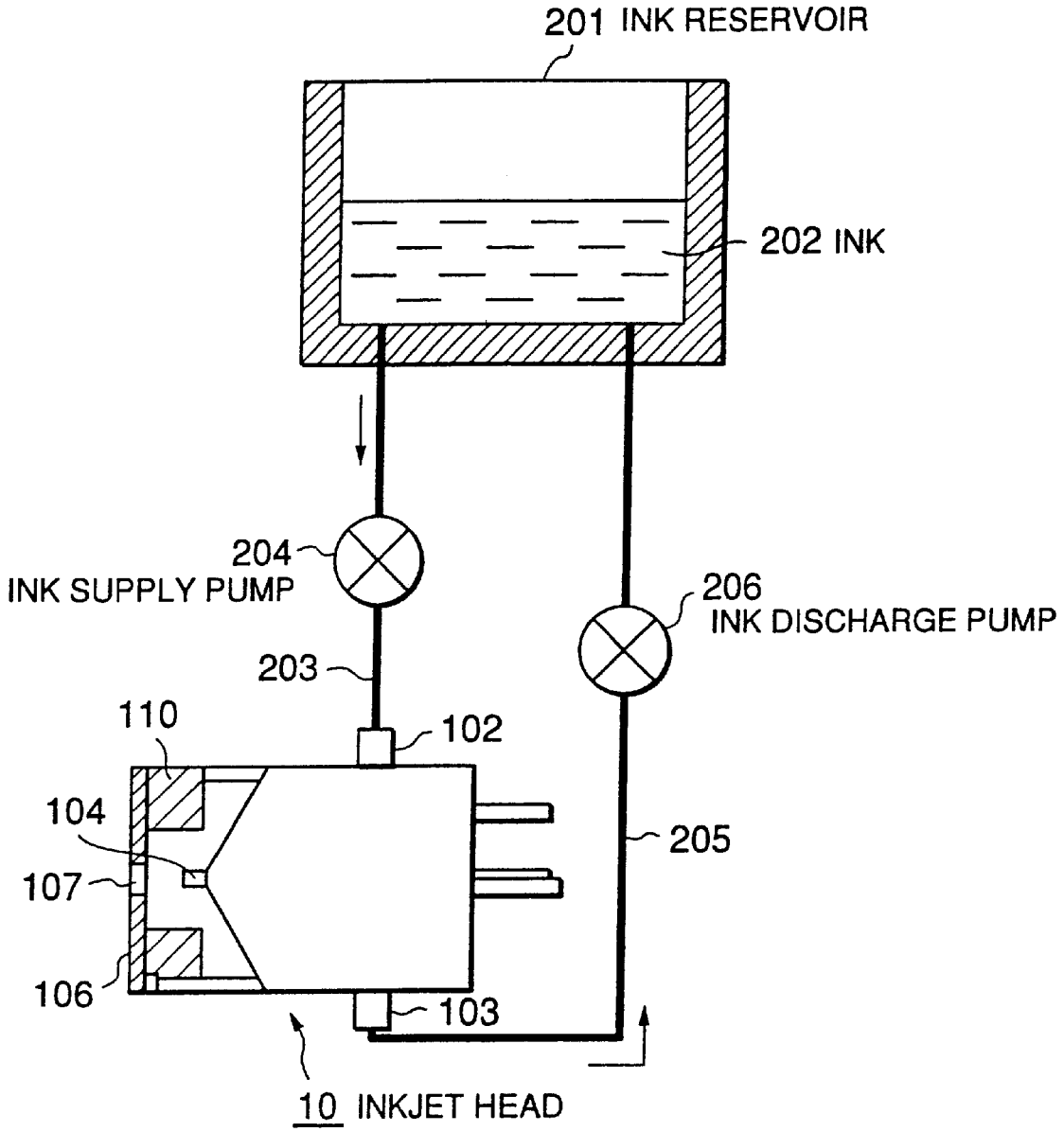
FIG. 3 is a diagram showing an ink circulating system for supplying ink to the embodiment.

Referring to FIG. 3, an ink reservoir 201 containing ink 202 is connected to the ink supply port 102 through an ink supply line 203 and an ink supply pump 204 and is further connected to the ink discharge port 103 through an ink discharge line 205 and an ink discharge pump 206. The insulating ink including charged toner may be used as the ink 202.

Figure 4:
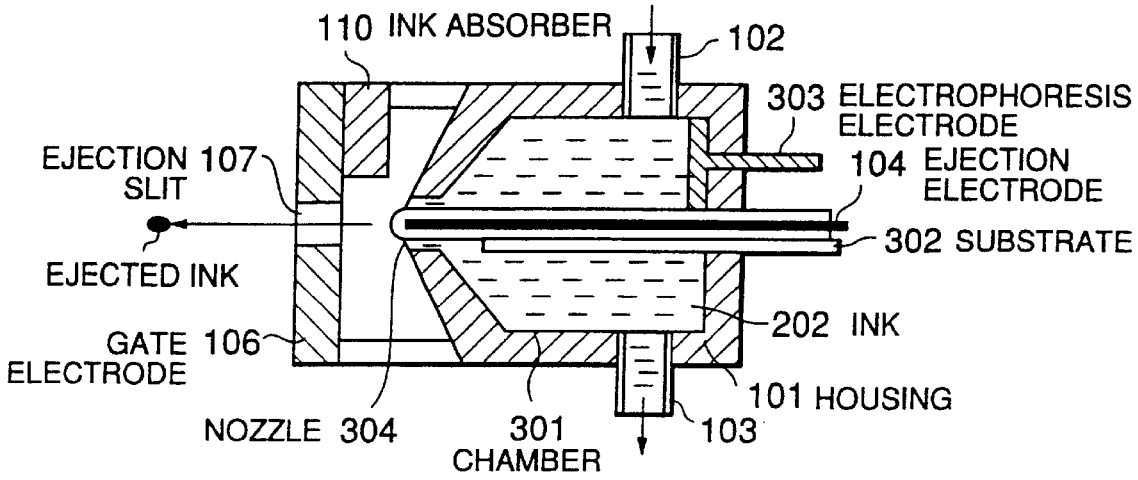
FIG. 4 is a cross-sectional view of the inkjet recording apparatus for explanation of advantages of the present invention.

Referring to FIG. 4, an ink chamber 301 is formed within the housing 101 made of an insulating material and the ink 202 is supplied into the chamber 301 through the ink supply port 102 and the ink reducing in toner concentration is discharged from the chamber 301 through the ink discharge port 103. Within the chamber 301 a substrate 302 made of an insulator is provided and has an array of needle-like ejection electrodes 104 formed thereon. Further, an electrophoresis electrode 303 is provided at the rear end of the upper half of the chamber 301. The ejection electrodes 101 are covered with an insulating film and are provided in the chamber 301 such that the front ends of the ejection electrodes 104 protrude through a nozzle 304 formed in the front surface of the hosing 101.

In the case where the chamber 301 is filled with the ink 202 supplied from the ink reservoir 201 and a predetermined positive voltage higher than the voltage of the gate electrode 106 is applied to the electrophoresis electrode 303, an electric field is generated in the chamber 301. The electric field moves the particulate matter such as toner particles toward the front ends of the ejection electrodes 104 due to the electrophoresis phenomenon and then the meniscuses are formed around the ejection electrodes 104, respectively.

In general, the ink ejection from an ejection electrode requires that a voltage difference between the ejection electrode and the gate electrode 106 is equal to or greater than a predetermined threshold value. If the voltage difference is smaller than the threshold value, the ink ejection from that ejection electrode cannot occur. Therefore, by controlling the voltage difference between each ejection electrode and the gate electrode 106, the ejection electrodes 104 selectively eject ink particles. Since the ejected ink is almost composed of toner particles, the ink flowing into the lower half of the chamber 301 through the ejection electrodes 104 reduces in toner concentration and it is discharged to the ink discharge port 103.

Figure 5:
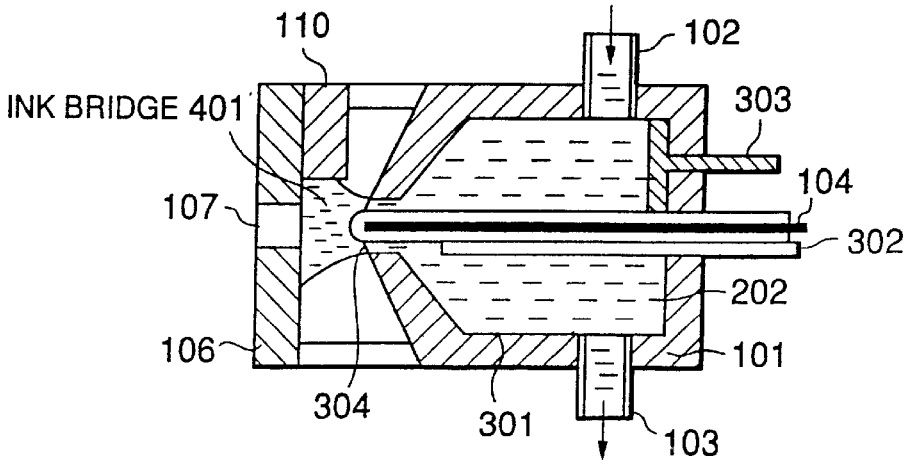
FIG. 5 is a cross-sectional view of the inkjet recording apparatus for explanation of advantages of the present invention.

Referring to FIG. 5, since the meniscuses are formed around the ejection electrodes 104, vibrations from head movement cause the ink to flow from the nozzle 304 to outside. The overflowing ink forms an ink bridge 401 between the nozzle 304 and the ejection slit 107 of the gate electrode 106. Since the gate electrode 106 has the drain slits 108 and 109 coupled to the ejection slit 107, the ink of the ink bridge 401 immediately flows into the drain slits 108 and 109. Therefore, the ink bridge 401 is drained from the ejection slit 107 and is then absorbed by the ink absorber 110 and 111.

As described before, the whole shape of the slits 107–109 is not limited to that as shown in FIG. 2 as long as the remaining ink is drained from the ejection slit 107. Another shape may be formed in the gate electrode 106 as shown in FIG. 6.

Figure 6:
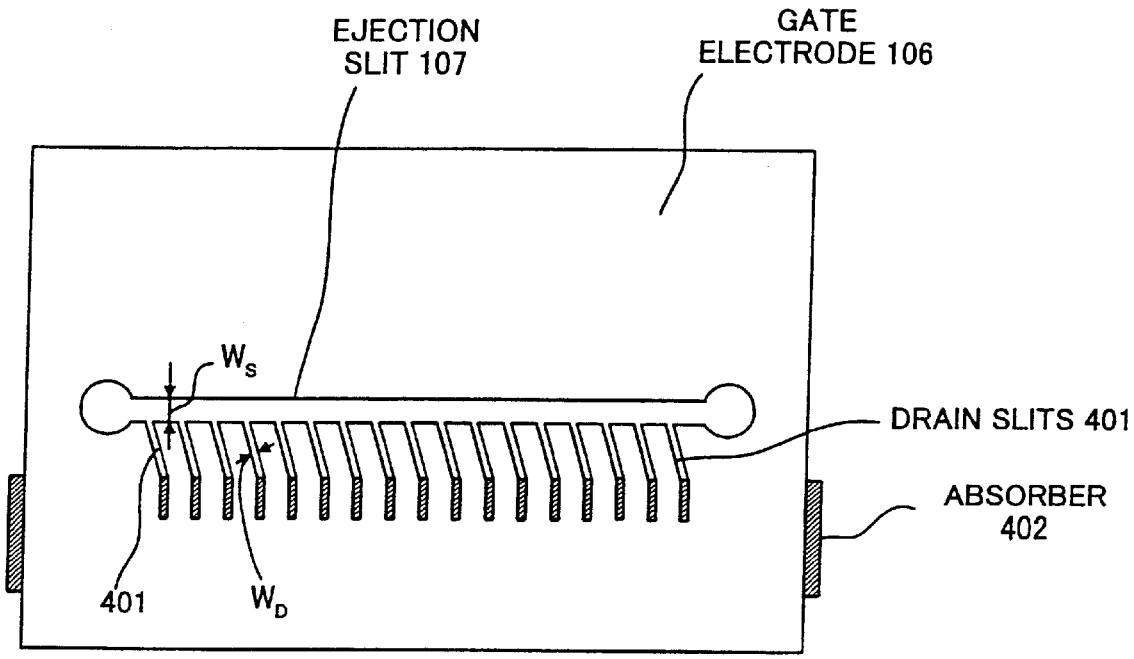
FIG. 6 is a plan view showing a gate electrode used in the inkjet recording apparatus according to another embodiment of the present invention.

Referring to FIG. 6, the ejection slit 107 is coupled to a plurality of drain slits 401 that are spaced at regular intervals in the longitude of the ejection electrode 107 with each drain slit extending in a downward direction. As in the case of Sig. 2, the width $W_D$ of each drain slit 401 is determined so that the capillary action occurs. Each of the drain slits 401 has a bend forming a first portion directly coupled to the ejection slit 107 and a second portion. The first portion extends on the skew with respect to the ejection slit 107. The second portion extends in the direction normal to the ejection slit 107. Further, an absorber 401 is placed on the back of the gate electrode 106 such that the second portions of the drain slits 401 are covered with a part of the absorber 402.

Since a plurality of drain slits 401 are spaced at regular intervals with each extending in a downward direction, the remaining ink is efficiently drained from the ejection slit 107. Further, it is preferable that each of the ejection electrodes 104 is placed at the position between two adjacent drain slits 401 to enhance ink draining.

While the invention has been described with reference to specific embodiments thereof, it will be appreciated by those skilled in the art that numerous variations, modifications, and any combination of the first and second embodiments are possible, and accordingly, all such variations, modifications, and combinations are to be regarded as being within the scope of the invention.

What is claimed is:

1. An inkjet head comprising:

a plurality of ejection electrodes arranged in an ink chamber containing ink including particulate matter for ejecting ink in a predetermined direction;

a front end plate placed at a predetermined distance in the predetermined direction from the ejection electrodes, the front end plate having a slit formed such that the ejection electrodes are directed to the slit;

the slit having a first and second end;

at least one ink drain coupled to the slit, for draining ink from the slit; and the at least one ink drain comprising at least one drain slit formed in the front end plate.

2. The inkjet head according to claim 1, wherein a width of the at least one drain slit is smaller than that of the slit so that capillary action occurs.

3. The inkjet head according to claim 1, wherein the at least first drain slit is formed at the first end of the slit and at least a second drain slit is formed at the second end of the slit.

4.The inkjet head according to claim 1, wherein the front end plate is a conductive plate to which a predetermined voltage is applied to generate a voltage difference causing ink ejection of an ejection electrode when the ejection electrode is driven.

5. An inkjet head comprising:

a plurality of ejection electrodes arranged in an ink chamber containing ink including particulate matter;

a front end plate placed at a predetermined distance from the ejection electrodes, the front end plate having a slit formed such that the ejection electrodes are directed to the slit;

the slit having a first and second end;

at least one ink drain coupled to the slit, for draining ink from the slit;

the at least one ink drain comprising at least one drain slit formed in the front end plate; and at least one ink absorber primarily disposed on the front end plate at a position corresponding to the at least one drain slit.

6. The inkjet head according to claim 5, wherein a width of the at least one drain slit is smaller than that of the slit so that capillary action occurs.

7. An inkjet head comprising:

a housing having an ink chamber therein, the ink chamber containing insulating ink including charged toner particles, the housing having an opening at a front end thereof;

a plurality of ejection electrodes arranged in the ink chamber with front ends of the ejection electrodes protruding through the opening for ejecting ink in a predetermined direction;

an electrophoresis electrode provided at a rear end within the ink chamber, for moving the charged toner particles toward the front ends of the ejection electrodes due to the electrophoresis phenomenon by applying a predetermined voltage thereto to form meniscuses around the front ends of the ejection electrodes;

a front end gate electrode plate placed at a predetermined distance in the predetermined direction from the ejection electrodes, the front end gate electrode plate having a slit formed such that the ejection electrodes are directed to the slit, wherein the front end gate electrode plate has at least one ink drain coupled to the slit to drain ink from the slit;

the slit having a first and second end; and the at least one ink drain comprising at least one drain slit formed in the front end gate electrode plate.

8. The inkjet head according to claim 7, wherein a width of the at least one drain slit is smaller than that of the slit so that capillary action occurs.

9. The inkjet head according to claim 7, wherein the at least a first drain slit is formed at the first end of the slit and at least a second drain slit is formed at the second end of the slit.

10. An inkjet head comprising:

a housing having an ink chamber therein, the ink chamber containing insulating ink including charged toner particles, the housing having an opening at a front end thereof;

a plurality of ejection electrodes arranged in the ink chamber with front ends of the ejection electrodes protruding through the opening;

an electrophoresis electrode provided at a rear end within the ink chamber, for moving the charged toner particles toward the front ends of the ejection electrodes due to the electrophoresis phenomenon by applying a predetermined voltage thereto to form meniscuses around the front ends of the ejection electrodes;

a front end gate electrode plate placed at a predetermined distance from the ejection electrodes, the front end gate electrode plate having a slit formed such that the ejection electrodes are directed to the slit, wherein the front end gate electrode plate has at least one ink drain coupled to the slit to drain ink from the slit;

the slit having a first and second end;

the at least one ink drain comprising at least one drain slit formed in the front end gate electrode plate; and at least one ink absorber proximally disposed on the front end gate electrode plate at a position corresponding to the at least one drain slit.

11. The inkjet head according to claim 10, wherein a width of the at least one drain slit is smaller than that of the slit so that capillary action occurs.

12. An inkjet head comprising:

a plurality of ejection electrodes arranged in an ink chamber containing ink including particulate matter;

a front end plate placed at a predetermined distance from the ejection electrodes, the front end plate having a slit formed such that the ejection electrodes are directed to the slit;

the slit having a first and second end;

at least one ink drain coupled to the slit, for draining ink from the slit; and the at least one ink drain comprising at least one drain slit formed in the front end plate a plurality of drain slits spaced at regular intervals between the first and second ends of the slit; and each one of the plurality of drain slits having an open end and a closed end.

13. The inkjet head according to claim 12, wherein each of the drain slits is formed in a downward direction.

14. The inkjet head according to claim 13, wherein each of the drain slits is formed at a predetermined angle with respect to the slit.

15. The inkjet head according to claim 12, wherein the ink drain further comprised an ink absorber provided to the front end plate at a position corresponding to the closed end portion of the drain slits.

16. The inkjet head according to claim 12, wherein a width of each of the drain slits is smaller than that of the slit so that capillary action occurs.

* * * * *